US011562867B2

(12) United States Patent
Zhao

(10) Patent No.: US 11,562,867 B2
(45) Date of Patent: Jan. 24, 2023

(54) MOVABLE CONTACT MECHANISM OF DOUBLE-BREAKPOINT CIRCUIT BREAKER

(71) Applicant: Jianping Zhao, Zhejiang (CN)

(72) Inventor: Jianping Zhao, Zhejiang (CN)

( * ) Notice: Subject to any disclaimer, the term of this patent is extended or adjusted under 35 U.S.C. 154(b) by 0 days.

(21) Appl. No.: 17/294,397

(22) PCT Filed: Jan. 15, 2019

(86) PCT No.: PCT/CN2019/071702
§ 371 (c)(1),
(2) Date: May 15, 2021

(87) PCT Pub. No.: WO2020/146996
PCT Pub. Date: Jul. 23, 2020

(65) Prior Publication Data
US 2022/0005658 A1 Jan. 6, 2022

(51) Int. Cl.
*H01H 33/04* (2006.01)
*H01H 33/42* (2006.01)

(52) U.S. Cl.
CPC ..... *H01H 33/04* (2013.01); *H01H 33/42* (2013.01)

(58) Field of Classification Search
CPC ..... H01H 33/04; H01H 33/42; H01H 1/2041; H01H 1/356; H01H 1/42; H01H 73/04; H01H 73/045; H01H 71/1009; H01H 71/52
USPC ..... 218/146, 16, 18, 21, 30, 48
See application file for complete search history.

(56) References Cited

U.S. PATENT DOCUMENTS 3,020,374 A * 2/1962 Tootelian ..... H01H 1/54 218/16
3,585,329 A * 6/1971 Walker ..... H01H 9/383 218/15
3,632,930 A * 1/1972 Parini ..... H01H 9/383 218/21
3,662,134 A * 5/1972 Cellerini ..... H01H 1/226 218/21
3,792,216 A * 2/1974 Gryctko ..... H01H 9/383 218/21
4,580,021 A * 4/1986 Fujikake ..... H01H 3/46 200/400
4,713,504 A * 12/1987 Maier ..... H01H 9/383 218/21

* cited by examiner

*Primary Examiner* — William A Bolton
(74) *Attorney, Agent, or Firm* — Houtteman Law LLC

(57) ABSTRACT

A movable contact mechanism of a double-breakpoint circuit breaker comprises a front static contact having a first contact point at the rear end, a rear contact assembly having a connecting plate with a rear static contact at the front end, and a movable contact which are placed in the horizontal direction, wherein an insertion slot is formed in the front end of the rear static contact the front contact end of the movable static is equipped with a second contact point matched with the first contact point, and the rear insertion end of the movable contact is inserted into or separated from the insertion slot and the opening or closing stroke of the first contact point and the second contact point is greater than the stroke that the rear insertion end of the movable contact is inserted into or separated from the insertion slot.

9 Claims, 2 Drawing Sheets

MOVABLE CONTACT MECHANISM OF DOUBLE-BREAKPOINT CIRCUIT BREAKER

TECHNICAL FIELD

The utility model relates to the technical field of circuit breakers, in particular to a movable contact mechanism of a double-breakpoint circuit breaker.

BACKGROUND OF THE UTILITY MODEL

There are many kinds of circuit breakers with the same basic working principles. Under abnormal conditions, the power supply lines can be quickly cut off to ensure the safety of electrical equipment and the power supply lines in a circuit system. The movable contact, as the core component of the circuit breaker, is used to divide and combine the power supply lines. When the power supply lines or the electrical equipment has overloaded or short-circuit fault, the movable contact is automatically opened and separated from the static contact, thereby quickly cutting off the power supply lines. And the electric arc generated between the moving and static contacts is rapidly elongated and then enters the arc extinguishing chamber.

At present, there are mainly two kinds of double-breakpoint circuit breakers on the market. The first one is to add a breakpoint in series or parallel on the movable contact of the original single-breakpoint circuit breaker, and form two electric-arc regions on one loop; although this structure can effectively improve the short-circuit breaking capacity, yet a larger electric arc will be generated between the moving and static contacts during separation as a result of the addition of the breakpoint, and the arc extinguishing chamber needs to be introduced to extinguish the electric arc. The production cost of the circuit breaker is increased as one arc extinguishing chamber is accordingly increased to double drive force of an operating mechanism of the product, and the outline size of the whole product is also increased (due to the presence of two arc extinguishing regions).

The second one includes a movable contact, a static contact, a flexible wire resistor and a conductive plate, where a first silver contact point is arranged below the head of the moving static, a second silver contact point is arranged above the head of the static contact, a third silver contact is arranged below the tail of the static contact, a fourth silver contact point is arranged above the tail of the conductive plate, the first silver contact point and the second silver contact point are in contact connection to form a first breakpoint of a break-way circuit, and the third silver contact point and the fourth silver contact point are in contact connection to form a second breakpoint of the break-way circuit. Although one resistor can be in series connected between the static contact and the conductive plate to form a high-resistance adsorption loop, the circuit breaker with the structure cancels one arc extinguishing chamber in comparison with other double-breakpoint structures. The flexible wire resistor (braided wire) is connected to the conductive plate by a welding way, so that a welding spot of a welded part is liable to drop; and after long-time use, the service life of the circuit breaker is affected by circuit breaker burning loss caused by too great temperature rise of the flexible wire resistor when the flexible wire resistor of the circuit breaker is liable to have a partial fracture phenomenon to result in the section of the flexible wire resistor to reduce.

In view of this, it is urgent to improve the structure of the current movable contact of the circuit breaker, so as to reduce the number of arc extinguishing chambers, improve the breaking capacity of the circuit breaker, reduce the cost, and prolong the service life of the circuit breaker.

SUMMARY OF THE UTILITY MODEL

The technical problem to be solved by the utility model is that the current movable contact of the circuit breaker has high production cost and a short service life.

To solve the technical problem, the technical solution adopted by the utility model is to provide a movable contact mechanism of a double-breakpoint circuit breaker, which is arranged in a casing of the double-breakpoint circuit breaker, comprising a front static contact which is horizontally arranged in front-rear direction and is provided with a first contact point at rear end, and further comprising:

a rear contact assembly which is arranged behind the front static contact, the rear contact assembly comprising a connecting plate, front end of the connecting plate being provided with a rear static contact, and an insertion slot being formed in the front end of the rear static contact;

and a movable contact which is arranged behind the static contact, middle part of the movable contact being connected to a lever mechanism through a connecting rod mechanism, the movable contact being provided with a front contact end and a rear insertion end, the front contact end of the movable contact being equipped with a second contact point matched with the first contact point, and the rear insertion end of the movable contact being inserted into or separated from the insertion slot, the movable contact being configured to:

when the lever mechanism is pushed to closed position, the second contact point fits to the first contact point, and the rear insertion end of the movable contact is inserted into the insertion slot to realize energizing;

when the lever mechanism is pulled to open position, the second contact point is separated from the first contact point, and the rear insertion end of the movable contact is separated from the insertion slot to realize de-energizing;

and opening or closing stroke of the first contact point and the second contact point is larger than stroke that the rear insertion end of the movable contact is separated from or inserted into the insertion slot.

In another preferred embodiment, the rear end of the rear static contact is equipped with two symmetrical clamping plates, front ends of the two clamping plates are respectively equipped with arc-shaped plates, and the insertion slot is formed in a gap between front end parts of the two arc-shaped plates.

In another preferred embodiment, limiting through holes are separately formed in the two clamping plates, a spring in shape of a split ring passes through two limiting through holes, and two free ends of the spring separately abut against outer sides of the arc-shaped plates.

In another preferred embodiment, the two free ends of the spring are separately forwards extended with semicircular or arc-shaped pressing parts.

In another preferred embodiment, the connecting plate includes a first connecting plate and a second connecting plate which are sequentially connected, and the rear static contact is detachably connected to the second connecting plate.

In another preferred embodiment, one side, away from the second contact point, of the movable contact is rewards extended with a bulged part, and a limiting slot adaptive to the bulged part is formed in top surface of the rear static contact.

In another preferred embodiment, the connecting rod mechanism includes an upper connecting rod and a lower connecting rod, the lever mechanism includes a jump latch and a lever rotatably arranged on the jump latch, and the jump latch is fixedly arranged on the casing of the circuit breaker through a pin roll.

In another preferred embodiment, the upper connecting rod is rotatably arranged on the jump latch, the lower connecting rod is rotatably arranged at lower end of the upper connecting rod, and the movable contact is rotatably arranged at lower end of the lower connecting rod.

In another preferred embodiment, the first contact point is arranged in an inclined mode, and an included angle of 1-20 degrees is formed between the first contact point and horizontal plane.

Compared with the prior art, in the utility model, the opening stroke of the first contact point and the second contact point is greater than the stroke that the rear insertion end of the movable contact is separated from or inserted into the insertion slot; when the lever mechanism is pulled to the open position, the second contact point is firstly separated from the first contact point, i.e., the front breakpoint is broken, and then the movable contact is separated from the insertion slot, i.e., the rear breakpoint is broken, which make the utility model have the advantage of strong breaking ability and the advantages of low production cost and a long service life as follows:

(1) The whole circuit breaker only needs one arc extinguishing chamber as the electric arc is not generated around the rear breakpoint, and thus, the circuit breaker is simple in structure and the production cost of the circuit breaker can be reduced.

(2) The movable contact is not separated from the insertion slot 81 when the second contact point 21 is separated from the first contact point 11, so that current loop can be blocked, electric-arc consumption time when the second contact point 21 is separated from the first contact point 11 is shorted, and thus, the service life of the circuit breaker is prolonged.

DETAILED DESCRIPTION OF THE PREFERRED EMBODIMENTS

The utility model provides a movable contact mechanism of a double-breakpoint circuit breaker, which has strong breaking capacity, a simple structure, low production cost and a long service life. In order to better understand the application schemes of the utility model by those skilled in the art, the technical solutions in the embodiments of the utility model will be clearly and completely described in the following with reference to the accompanying drawings in the embodiments. It is obvious that the described embodiments are only a part of the embodiments of the utility model, and not all of the embodiments. All other embodiments obtained by persons of ordinary skill in the art based on the embodiments of the utility model without creative efforts shall fall within the protection scope of the utility model.

It should be noted that the terms "first", "second", and the like in the specification and claims of the utility model are used to distinguish similar objects, and are not necessarily used to describe a specific order or order. It should be understood that the data so used may be interchanged where appropriate to facilitate the embodiments of the utility model described herein.

Figure 1:
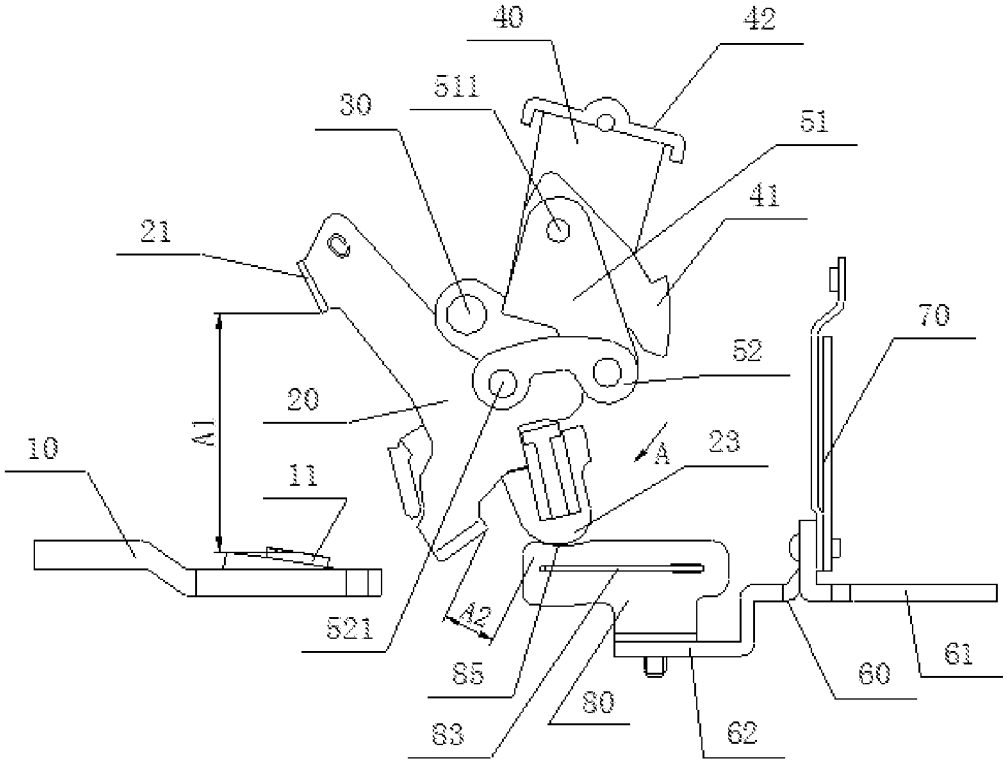
FIG. 1 is a structural diagram in an open position of the utility model.
Figure 3:
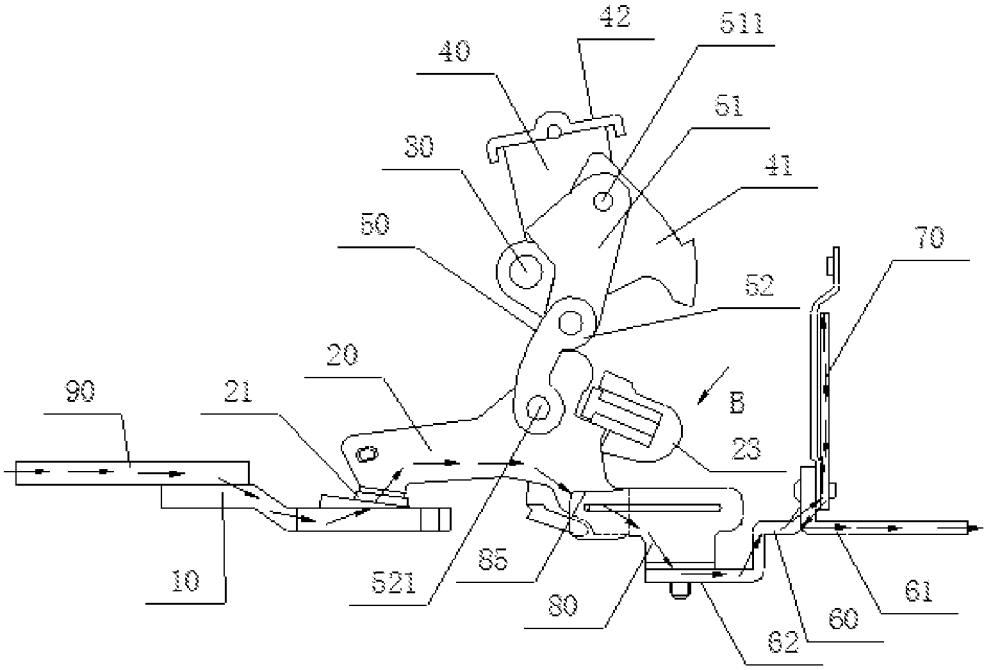
FIG. 3 is a structural diagram in a closed position of the utility model.

In the utility model, the orientation or positional relationship indicated by "front", "back", "upper", "lower", "vertical", "horizontal", etc., is based on the orientation or positional relationship shown in the drawings. As shown in FIG. 1 and FIG. 3, the left side is positioned as the front, the right side is defined as the back, and the upper and the lower are defined as the reference plane. These terms are primarily intended to describe the utility model and its embodiments, and are not intended to limit the particular orientation of the indicated devices, elements or components, or configure and operation in particular orientation.

In addition, the term "provided" shall be understood broadly and may be a fixed connection, a detachable connection, or a unitary construction; it may be a mechanical connection, or an electrical connection; it may be direct connection or indirect connection through an intermediate medium, or internal communication between two devices, elements or components. For those of ordinary skill in the art, the specific meanings of the above terms in the utility model can be understood according to the specific condition.

As shown in FIG. 1 and FIG. 3, the utility model provides a movable contact mechanism of a double-breakpoint circuit breaker, which is arranged in a casing of the double-breakpoint circuit breaker for connecting or disconnecting power supply lines. The movable contact mechanism includes a front static contact 10 which is horizontally arranged in the front-rear direction, a movable contact 20 which is matched with the front static contact 10 and a rear contact assembly, where the movable contact 20 and the rear contact assembly are both arranged behind the front static contact 10.

Figure 2:
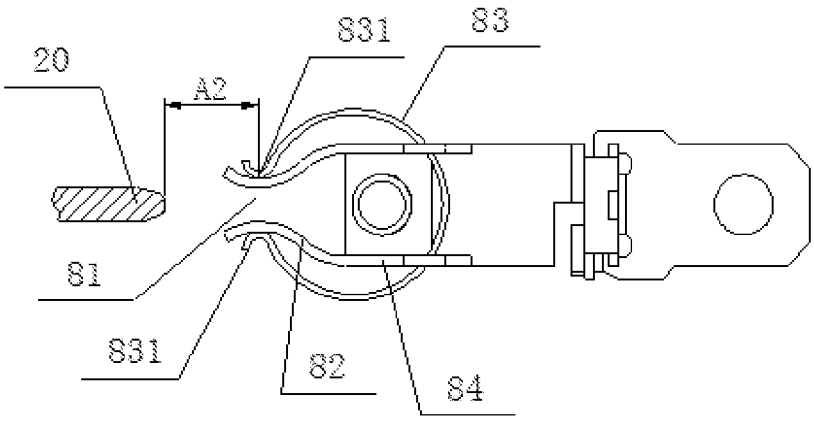
FIG. 2 is a A-direction view in FIG. 1.
Figure 4:
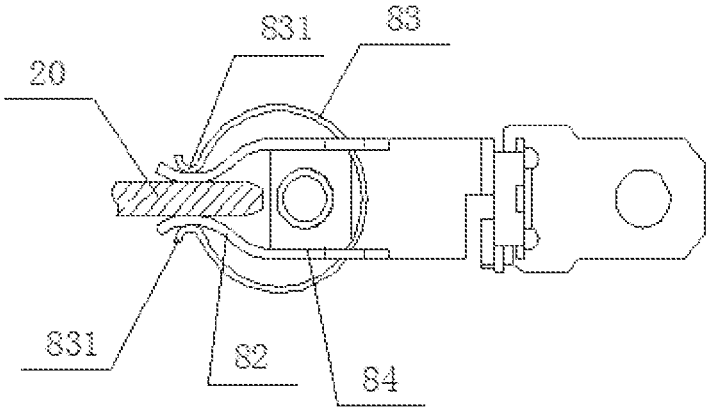
FIG. 4 is a B-direction view of the FIG. 3.

The rear contact assembly includes a connecting plate 60, the front end of the connecting plate 60 is equipped with a rear static contact 80 and the rear end of the connecting plate 60 is equipped with a heating element 70. As shown in FIG. 2 and FIG. 4, an insertion slot 81 is formed in the front end of the rear static contact 80.

The rear end of the front static contact 10 is equipped with a first contact point 11. The movable contact 20 is provided with a front contact end and a rear insertion end, the front contact end is equipped with a second contact point 21 matched with the first contact point 11, and the rear insertion end is matched with an insertion slot 81 in the front end of the rear static contact 80 and can be inserted into or separated from the insertion slot 81.

The middle part of the movable contact 20 is connected to a lever mechanism 40 through a connecting rod mechanism 50, and the lever mechanism 40 can be operated to drive the movable contact 20 to rotate clockwise or anticlockwise for connecting or disconnecting the power supply lines as follows:

As shown in FIG. 3 and FIG. 4, when the lever mechanism 40 is pushed to the closed position, the connecting rod mechanism 50 drives the movable contact 20 to rotate anticlockwise, the second contact point 21 fits to the first contact point 11, and the rear insertion end of the movable contact 20 is inserted into the insertion slot 81 to realize energizing.

As shown in FIG. 1 and FIG. 2, when the lever mechanism 40 is pulled to the open position, the connecting rod 50 drives the movable contact 20 to rotate clockwise, the second contact point 21 is separated from the first contact point 11, and the rear insertion end of the movable contact 20 is separated from the insertion slot 81 to realize de-energizing.

In the utility model, the opening or closing stroke of the first contact point 11 and the second contact point 21 is larger than the stroke A2 that the rear insertion end of the movable contact 20 is separated from or inserted into the insertion slot 81. Therefore, in an energizing process, the rear insertion end of the movable contact 20 is firstly inserted into the insertion slot 81 and then the second contact point 21 fits to the first contact point 11; and in the de-energizing process, the second contact point 21 is firstly separated from the first contact point 11, i.e., the front breakpoint is broken, and then the rear insertion end of the movable contact 20 is separated from the insertion slot 81, i.e., the rear breakpoint is broken, and the this way has the following advantages:

(1) The whole circuit breaker only needs one arc extinguishing chamber as the electric arc is not generated around the rear breakpoint, and thus, the circuit breaker is simple in structure and the production cost of the circuit breaker can be reduced.

(2) The movable contact is not separated from the insertion slot 81 when the second contact point 21 is separated from the first contact point 11, so that current loop can be blocked, electric-arc consumption time when the second contact point 21 is separated from the first contact point 11 is shorted, and thus, the service life of the circuit breaker is prolonged.

The front breakpoint is disconnected for the A1 stroke, and the rear breakpoint is disconnected for the A2 stroke. Compared with the prior art, an A2 stroke is added, and the disconnection stroke is increased, thereby improving the breaking capacity of the circuit breaker without changing the current case of the circuit breaker operating mechanism and the housing, effectively improving the breaking capacity of the circuit breaker; and this connecting way can be applied to various miniature circuit breakers, molded case circuit breakers, framework circuit breakers and smart circuit breakers.

As shown in FIG. 2 and FIG. 4, the rear end of the rear static contact 80 is equipped with two symmetrical clamping plates 84, the front ends of the two clamping plates 84 are respectively equipped with arc-shaped plates 82, and the insertion slot 81 is formed in a gap between the front end parts of the two arc-shaped plates 82; the smallest width of the insertion slot 81 is smaller than that of the movable contact 20; and the way of forming the insertion slot 81 by the two arc-shaped plates 82 is simple in structure and low in production cost.

Limiting through holes are separately formed in the two clamping plates 84, a spring 83 in the shape of a split ring passes through the two limiting through holes, and the two free ends of the spring 83 separately abut against the outer sides of the arc-shaped plates 82; when the movable contact 20 is inserted into the insertion slot 81, the inner wall of the insertion slot 81 tightly fits to the movable contact 20 under action of the spring 83, the spring 83 is a high-temperature-resistant reinforced type, and can stably keep certain force value under electrifying and heating states of the rear static contact 80, so that the circuit breaker is kept in an on-state, and thus, short-time withstand current of the circuit breaker is improved.

The two free ends of the spring 83 are separately forwards extended with semicircular or arc-shaped pressing parts 831 which make the spring 83 tightly buckle on the arc-shaped plates 82; and while the movable contact 20 is inserted into the insertion slot 81, the insertion slot 81 and the movable contact 20 are guaranteed to be tightly fitted.

As shown in FIG. 1 and FIG. 3, the connecting plate 60 includes a first connecting plate 61 and a second connecting plate 62 which are sequentially connected, and the rear static contact 80 is detachably connected to the second connecting plate 62. This connecting way is simple in structure, convenient to dismount, and can realize modularized connection and intelligent assembly.

One side, away from the second contact point 21, of the movable contact 20 is rewards extended with a bulged part 23, and a limiting slot 85 adaptive to the bulged part 23 is formed in the top surface of the rear static contact 80; and the bulged part 23 is configured to:

As shown in FIG. 1, when the lever mechanism 40 is pushed to the open position, the burgled part 23 is blocked in the limiting slot 85 for achieving limiting effect on the movable contact 20.

As shown in FIG. 3, when the lever mechanism 40 is pushed to the closed position, the bulged part 23 is away from the limiting slot 85.

The connecting rod mechanism 50 includes an upper connecting rod 51 and a lower connecting rod 52, the lever mechanism 40 includes a jump latch 41 and a lever 42 rotatably arranged on the jump latch 41, and the jump latch 41 is fixedly arranged on the casing of the circuit breaker through a pin roll 30. The upper connecting rod 51 is rotatably arranged on the jump latch 41, the lower connecting rod 52 is rotatably arranged at the lower end of the upper connecting rod 51, the movable contact 20 is rotatably arranged at the lower end of the lower connecting rod 52, and the upper connecting rod 51 and the lower connecting rod 52 are connected, so that the movable contact 20 is driven by the lever 42 to flexibly rotate.

The specific configuration of driving the movable contact 20 to turn on or off the power supply circuit by operating the lever mechanism 40 is as follows:

As shown in FIG. 3 and FIG. 4, when the lever mechanism 40 is pushed to the closed position, the upper connecting rod 51 rotates anticlockwise along an upper rotary shaft 511, and the lower connecting rod 52 drives the movable contact 20 to rotate anticlockwise along a lower rotary shaft 521, so that the second contact point 21 fits to the first contact point 11, and the rear insertion end of the movable contact 20 is inserted into the insertion slot 81 to realize energizing.

As shown in FIG. 1 and FIG. 2, when the lever mechanism 40 is pulled to the open position, the upper connecting rod 51 rotates clockwise along an upper rotary shaft 511, and the lower connecting rod 52 drives the movable contact 20 to rotate clockwise along a lower rotary shaft 521, so that the second contact point 21 is separated from the first contact point 11, and the rear insertion end of the movable contact 20 is separated from the insertion slot 81 to realize de-energizing.

The first contact point 11 is arranged in an inclined mode, and an included angle of 1-20 degrees is formed between the first contact point 11 and the horizontal plane. With the structural design, at the closed position, the second contact point 21 fits to the first contact point 11 more tightly.

The working process of the utility model is as follows:

(1) As shown in FIG. 3 and FIG. 4, under the normal working state, the first contact point 11 fits to the second contact point 21, the movable contact 20 is inserted into the insertion slot 81, the circuit breaker is in an on-state, and a flow direction of current is as follows: external connecting terminal 90, front static contact 10, movable contact 20, rear static contact 80, second connecting plate 62, heating element 70 and first connecting plate 61.

(2) As shown in FIG. 1 and FIG. 2, when the electrical equipment has overload or short-circuit fault, the upper connecting rod 51 rotates clockwise along the upper rotary shaft 511, and the lower connecting rod 52 drives the movable contact 20 to rotate clockwise along the lower rotary shaft 521, so that the second contact point 21 is separated from the first contact point 11, and the movable contact 20 is separated from the insertion slot 81 to realize automatic de-energizing.

The utility model is not limited to the above-described preferred embodiments, and any person should be aware of the structural changes made in the light of the utility model. Any technical solutions having the same or similar to those of the utility model shall fall into the scope of protection of the utility model.

What is claimed is:

1. A movable contact mechanism of a double-breakpoint circuit breaker, which is arranged in a casing of the double-breakpoint circuit breaker, comprising a front static contact which is horizontally arranged in a front-rear direction and is provided with a first contact point at a rear end, and further comprising:

a rear contact assembly which is arranged behind the front static contact, the rear contact assembly comprising a connecting plate, a front end of the connecting plate being provided with a rear static contact, and an insertion slot being formed in the front end of the rear static contact;

and a movable contact which is arranged behind the static contact, a middle part of the movable contact being connected to a lever mechanism through a connecting rod mechanism, the movable contact being provided with a front contact end and a rear insertion end, the front contact end of the movable contact being equipped with a second contact point matched with the first contact point, and the rear insertion end of the movable contact being inserted into or separated from the insertion slot, the movable contact being configured to:

when the lever mechanism is pushed to a closed position, the second contact point fits to the first contact point, and the rear insertion end of the movable contact is inserted into the insertion slot to realize energizing;

when the lever mechanism is pulled to an open position, the second contact point is separated from the first contact point, and the rear insertion end of the movable contact is separated from the insertion slot to realize de-energizing;

and an opening or closing stroke of the first contact point and the second contact point is larger than a stroke that the rear insertion end of the movable contact is separated from or inserted into the insertion slot.

2. The movable contact mechanism of the double-breakpoint circuit breaker according to claim 1, wherein the rear end of the rear static contact is equipped with two symmetrical clamping plates, front ends of the two clamping plates are respectively equipped with arc-shaped plates, and the insertion slot is formed in a gap between front end parts of the two arc-shaped plates.

3. The movable contact mechanism of the double-breakpoint circuit breaker according to claim 2, wherein limiting through holes are separately formed in the two clamping plates, a spring in a shape of a split ring passes through two limiting through holes, and two free ends of the spring separately abut against outer sides of the arc-shaped plates.

4. The movable contact mechanism of the double-breakpoint circuit breaker according to claim 3, wherein the two free ends of the spring are separately forwards extended with semicircular or arc-shaped pressing parts.

5. The movable contact mechanism of the double-breakpoint circuit breaker according to claim 1, wherein the connecting plate comprises a first connecting plate and a second connecting plate which are sequentially connected, and the rear static contact is detachably connected to the second connecting plate.

6. The movable contact mechanism of the double-breakpoint circuit breaker according to claim 1, wherein one side, away from the second contact point, of the movable contact is rewards extended with a bulged part, and a limiting slot adaptive to the bulged part is formed in a top surface of the rear static contact.

7. The movable contact mechanism of the double-breakpoint circuit breaker according to claim 1, wherein the connecting rod mechanism comprises an upper connecting rod and a lower connecting rod, the lever mechanism comprises a jump latch and a lever rotatably arranged on the jump latch, and the jump latch is fixedly arranged on the casing of the circuit breaker through a pin roll.

8. The movable contact mechanism of the double-breakpoint circuit breaker according to claim 7, wherein the upper connecting rod is rotatably arranged on the jump latch, the lower connecting rod is rotatably arranged at a lower end of the upper connecting rod, and the movable contact is rotatably arranged at a lower end of the lower connecting rod.

9. The movable contact mechanism of the double-breakpoint circuit breaker according to claim 1, wherein the first contact point is arranged in an inclined mode, and an included angle of 1-20 degrees is formed between the first contact point and a horizontal plane.

* * * * *